US012297730B1

(12) United States Patent
Arkadakskiy et al.

(10) Patent No.: US 12,297,730 B1
(45) **Date of Patent: *May 13, 2025**

(54) METHODS OF STIMULATING GEOLOGICAL FORMATIONS WITH ACIDIC FRACTURING FLUIDS

(71) Applicant: Saudi Arabian Oil Company, Dhahran (SA)

(72) Inventors: Serguey Viktorov Arkadakskiy, Dhahran (SA); Zeyad Tareq Ahmed, Dhahran (SA); Noushad Kunnummal, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 18/422,524

(22) Filed: Jan. 25, 2024

(51) Int. Cl.
*E21B 43/27* (2006.01)
*E21B 41/00* (2006.01)

(52) U.S. Cl.
CPC ..... *E21B 43/27* (2020.05); *E21B 41/0064* (2013.01)

(58) Field of Classification Search
CPC ..... E21B 43/27; E21B 41/0064
See application file for complete search history.

(56) References Cited

U.S. PATENT DOCUMENTS

| | | | | |
|---|---|---|---|---|
| 4,527,627 | A | 7/1985 | Graham et al. | |
| 5,310,003 | A | 5/1994 | Jennings | |
| 11,155,462 | B2 | 10/2021 | Arkadakskiy et al. | |
| 2020/0317513 | A1* | 10/2020 | Arkadakskiy | C01B 32/60 |
| 2022/0288526 | A1* | 9/2022 | Ahmed | B01D 53/1468 |
| 2023/0038447 | A1* | 2/2023 | Hasan | E21B 41/0064 |
| 2023/0235214 | A1* | 7/2023 | Hasan | E21B 43/164 166/279 |

OTHER PUBLICATIONS

Canziani, "EcoTechnologies for Wastewatr Treatment", The International Water Associates Conference Proceedings, Jun. 23-27, 5 pages, 2014.
Gislason et al., "A brief history of CarbFix: Challenges and victories of the project's pilot phase", Energy Procedia, vol. 146, pp. 103-114, 2018.
Gunnarsson et al., "The rapid and cost-effective capture and subsurface mineral storage of carbon and sulfur at the CarFix2 site", International Journal of Greenhouse Gas Control, vol. 79, pp. 117-126, 2018.
Koide et al., "Carbon microbubbles sequestration: a novel technology for stable underground emplacement of greenhouse gases into wide variety of saline aquifers, fractured rocks and tight reservoirs", Energy Prodedia, vol. 1, pp. 3655-3662, 2009.
Meegoda et al., "Stability of Nanobubbles", Environmental Engineering Science, vol. 00, No. 00, 12 pages, 2018.
Mito et al., "Geochemical trapping of CO2 in saline aquifer storage: Results of repeated formation fluid sampling at the Nagaoka site", Energy Procedia, vol. 37, pp. 5449-5455, 2013.
Snoebjornsdottir et al., "Carbon dioxide storage through mineral carbonation", Nat Rev Earth Environ, vol. 1, pp. 90-102, 2020.
Suzuki et al., "Feasibility Study on CO2 Micro-Bubble Storage (CMS)", Energy Procedia, vol. 37, pp. 6002-6009, 2013.
Wang et al., "Preparation and Properties of CO2 Micro-Nanobubble Water Based on Response Surface Methodology", Applied Sciences, vol. 11, 15 pages, 2021.
Xue et al., "Microbubble carbon dioxide injection for enhanced dissolution in geological sequestrtion and improved oil recovery", Energy Procedia, vol. 63, pp. 7939-7946, 2014.
Zhou et al., "Long-Term Stability of Different Kinds of Gas Nanobubbles in Deionized and Salt Water", Materials, vol. 14, No. 1808, 20 pages, 2021.
Abrams, et al., "Higher-pH Acid Stimulation Systems", Society of Petroleum Engineers of AIME, Journal of Petroleum Technology, pp. 2175-2184, Dec. 1983.
Gysi et al., "CO2-water-basalt interaction. Numberical simulation of low temperature CO2 sequestration into basalts", Geochimica et Cosmochima Acta, vol. 75, pp. 4728-4751, 2011.
Metcalf et al., "Aecitic Acid Demonstrates Greater Carbonate Dissolution Thank Typically Expected", Canadian International Petroleum Conference, 9 pages, Jun. 8-10, 2004.
Middleton et al., "CO2 as a fracturing fluid: Potential for commercial-scale shale gas production and CO2 sequestration", Energy Procedia, vol. 63, pp. 7780-7784, 2014.
Oelkers et al., "Mineral Carbonation of CO2", Elements, vol. 4, pp. 333-337, Oct. 2008.
Wiese et al., "CO2 fixation by calcite in high-temperature geothermal systems in Iceland", ÍSOR-2008/003, 2008.
Suleimenova, et al., "Comparative Study of Acid Fracturing and Propped Hydraulic Fracturing for a Tight Carbonate Formation", Society of Petroleum Engineers, SPE Europec, 78th EAGE Conference and Exhibition, SPE-180114-MS, May 30-Jun. 2, 2016.

* cited by examiner

*Primary Examiner* — Silvana C Runyan
(74) *Attorney, Agent, or Firm* — DINSMORE & SHOHL LLP

(57) ABSTRACT

A method of stimulating a geological formation and sequestering $CO_2$ in the geological formation may include positioning an acidic fracturing fluid comprising dissolved $CO_2$ and $CO_2$ microbubbles and/or $CO_2$ nanobubbles in the geological formation, hydraulic fracturing the geological formation, acidizing the geological formation with the acidic fracturing fluid, thereby increasing a permeability of the geological formation, and sequestering $CO_2$ by reacting the $CO_2$ in the acidic fracturing fluid with reactive rock in the geological formation to form carbonates.

19 Claims, 2 Drawing Sheets

METHODS OF STIMULATING GEOLOGICAL FORMATIONS WITH ACIDIC FRACTURING FLUIDS

FIELD

Embodiments disclosed herein generally relate to improved $CO_2$ sequestration in geological formations, and more specifically, to methods of stimulating a geological formation.

TECHNICAL BACKGROUND

Sequestration of gases is desired in a variety of applications, including but not limited to, the reduction of greenhouse gases and gas storage. Many industries, including but not limited to $H_2$ or ammonia production, power generation, cement production, and water desalinization produce $CO_2$ and other harmful gases, and these therefore require efficient methods of $CO_2$ sequestration. Such methods may include using $CO_2$ capture in water and injecting that into geological formations comprised predominantly or in part of reactive minerals and/or reactive rock fragments where $CO_2$ is permanently trapped by chemical conversion to solid minerals such as carbonates. Currently those methods include scrubbing the $CO_2$ in water at surface prior to injecting the gas-loaded aqueous fluids in an injection well, or injecting the $CO_2$ in a stream of carrier water inside the wellbore of an injection well, where $CO_2$ dissolves completely before the gas-loaded fluid reaches the target formation. The permeability of geological formations that receive the gas-loaded aqueous fluid and/or produce the carrier water needed to prepare this gas-loaded fluid is a critical limiting factor to the rate at which $CO_2$ may be sequestered in geological formations. Thus, systems and methods to more effectively and efficiently inject dissolved $CO_2$ and/or produce the carrier water needed for the dissolution and delivery of the $CO_2$ into geological formations where the $CO_2$ is sequestered are needed.

SUMMARY

Geological formation permeability plays an important role in sequestering $CO_2$ by using a method known as in-situ mineralization of $CO_2$ in reactive rocks. In-situ mineralization of $CO_2$ in reactive rocks generally require large volumes of carrier water for dissolving the $CO_2$ (and other water-soluble waste gases, e.g. $H_2S$) and delivering the gas-loaded aqueous fluids into the reactive geological formations for sequestration. In some cases this carrier water is sourced from wells drilled in groundwater aquifers comprised of reactive rocks. Examples of reactive rocks include igneous rocks of volcanic, and plutonic origin such as basalt, andesite, gabbro, anorthosite, pyroxenite, peridotite, etc., as well as clastic sedimentary rocks such as conglomerate, sandstone, etc. that consist entirely or in part of rock fragments or minerals of reactive rock origin. Such rocks may possess both primary (matrix) and secondary (fracture) permeability. Crystalline reactive rocks such as gabbro, ultramafics, etc. as well as altered volcanic and volcaniclastic rocks or fully cemented clastic sedimentary rocks that consist entirely or in part of reactive rock fragments and minerals however, may lack substantial primary (matrix) permeability. Therefore, the injection of water-$CO_2$ mixture and/or the production of the carrier water needed for delivering the $CO_2$ into and from geological formations comprising these rock types may require sufficient secondary permeability. Secondary permeability could be natural (e.g., fracturing and faulting developed as a result of tectonic processes), or could be augmented by well stimulation activities such as hydraulic fracturing, thermal fracturing, and acidification. Conventional acidizing treatments generally include strong acids to increase a permeability of a geological formation by dissolving acid soluble minerals. However, acidification with strong acids, may also produce insoluble (non-reactive) crystalline and/or amorphous mineral phases that may reduce the permeability of the geological formation, among other disadvantages, such as the production of free-phase gaseous $CO_2$, which may further damage formation permeability, as well as by causing increased corrosion of the wellbore and equipment. To avoid the issues associated with using strong acids, and in particular the excessive production of insoluble, nonreactive phases in the geological formation, embodiments disclosed herein may include methods of stimulating a geological formation. The methods may include a combination of hydraulic fracturing and acidification of geological formations targeted for $CO_2$ sequestration and/or for carrier water production by treating the geological formation with an acidic fracturing fluid that includes dissolved $CO_2$ and/or is enriched with $CO_2$ micro/nanobubbles.

According to one or more embodiments of the present disclosure, a method of stimulating a geological formation may include: positioning an acidic fracturing fluid comprising dissolved $CO_2$ and $CO_2$ microbubbles and/or $CO_2$ nanobubbles in the geological formation; hydraulic fracturing the geological formation; acidizing the geological formation with the acidic fracturing fluid, thereby increasing a permeability of the geological formation; and sequestering $CO_2$ by reacting the $CO_2$ in the acidic fracturing fluid with reactive rock in the geological formation to form carbonates.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing summary and the following detailed description are merely exemplary, and are intended to provide an overview or framework to understand the nature and character of the claims. The drawings are included to provide a further understanding of the embodiments and, together with the detailed description, serve to explain the principles and operations of the claimed subject matter. However, the embodiments depicted in the drawings are illustrative and exemplary in nature, and not intended to limit the claimed subject matter.

When describing the simplified schematic illustration of FIG. 2, the numerous valves, temperature sensors, compressors, electronic controllers, pumps and the like, which may be used and are well known to a person of ordinary skill in the art, are not included. Further, accompanying components that are often included in systems such as those depicted in FIG. 2, such as wellbore casing, wellbore stabilizers, hydraulic fracturing equipment, acidizing equipment, and the like are also not included. However, a person of ordinary skill in the art understands that these components are within the scope of the present disclosure.

Additionally, the arrows in the simplified schematic illustration of FIG. 2 refer to process streams. However, the arrows may equivalently refer to transfer lines, which may transfer process steams between two or more system components. Arrows that connect to one or more system components signify inlets or outlets in the given system components and arrows that connect to only one system component signify a system outlet stream that exits the depicted system or a system inlet stream that enters the depicted system. The arrow direction generally corresponds with the major direction of movement of the process stream or the process stream contained within the physical transfer line signified by the arrow.

The arrows in the simplified schematic illustration of FIG. 2 may also refer to process steps of transporting a process stream from one system component to another system component. For example, an arrow from a first system component pointing to a second system component may signify "passing" a process stream from the first system component to the second system component, which may comprise the process stream "exiting" or being "removed" from the first system component and "introducing" the process stream to the second system component.

BRIEF DESCRIPTION OF DRAWINGS

While the specification concludes with claims particularly pointing out and distinctly claiming the subject matter of the description, it is believed that the description will be better understood from the following specification when taken in conjunction with the accompanying drawings, wherein:

DETAILED DESCRIPTION

Figure 1:
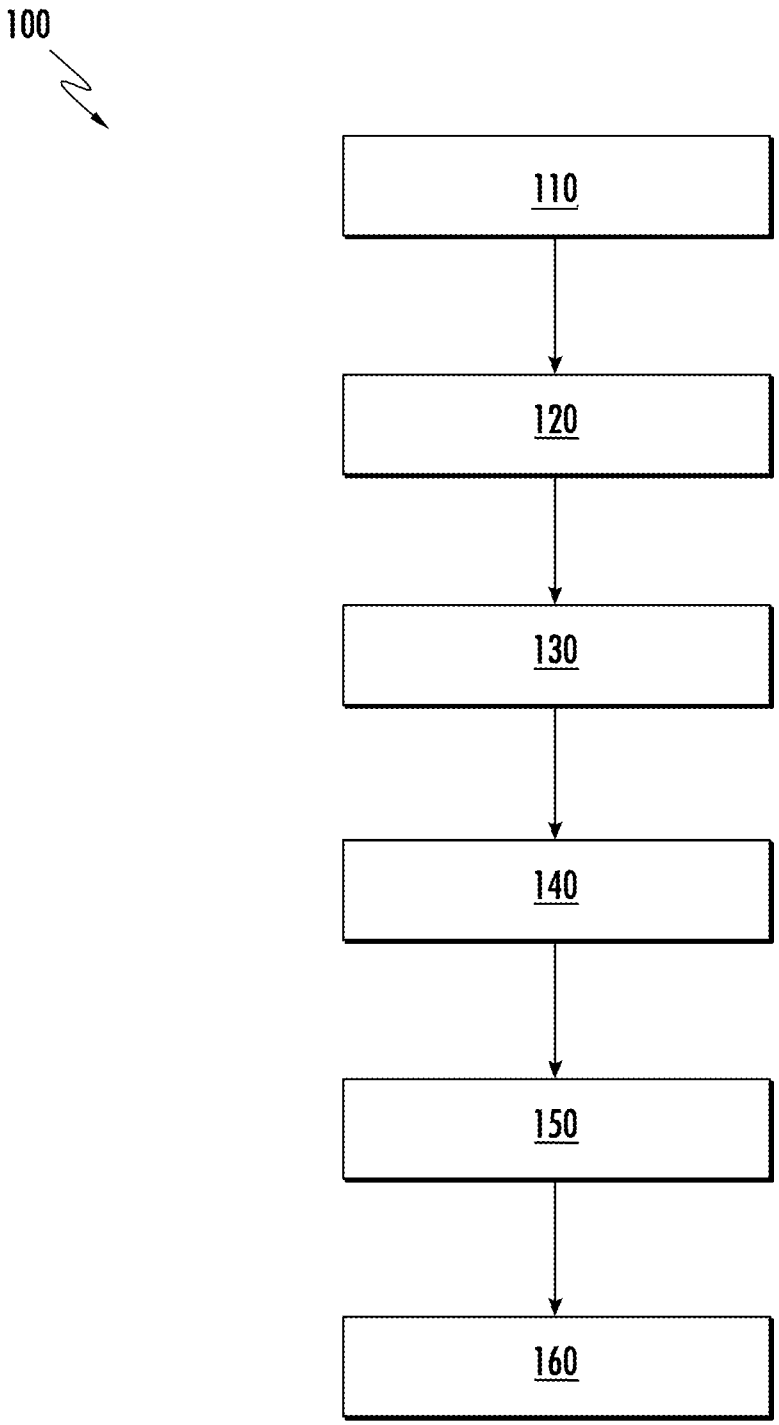
FIG. 1 is a flowchart of a method of forming a glass substrate, according to embodiments disclosed herein.

Reference will now be made in detail to embodiments of the present application, various embodiments of which will be described herein with specific reference to the accompanying drawings. Whenever possible, the same reference numerals will be used throughout the drawings to refer to the same or like parts. The present disclosure is directed to methods of stimulating a geological formation with an acidic fracturing fluid. Such methods may be useful for sequestering carbon dioxide ($CO_2$) in the geological formation. Further, such methods may be useful for increasing a production rate of water from a water production well, which may improve methods of sequestering $CO_2$ due to the high volume demand of carrier water. Embodiments of the present disclosure may include a method comprising positioning an acidic fracturing fluid comprising dissolved $CO_2$ and $CO_2$ microbubbles and/or $CO_2$ nanobubbles in the geological formation, hydraulic fracturing the geological formation, acidizing the geological formation with the acidic fracturing fluid, thereby increasing a permeability of the geological formation, and sequestering $CO_2$ by reacting the $CO_2$ in the acidic fracturing fluid with reactive rock in the geological formation to form carbonates.

In the following detailed description, numerous specific details may be set forth in order to provide a thorough understanding of embodiments described herein. However, it will be clear to one skilled in the art when embodiments may be practiced without some or all of these specific details. In other instances, well-known features or processes may not be described in detail so as not to unnecessarily obscure the disclosure. In addition, like or identical reference numerals may be used to identify common or similar elements. Moreover, unless otherwise defined, all technical and scientific terms used herein have the same meaning as commonly understood by one of ordinary skill in the art to which this disclosure belongs. In case of conflict, the present specification, including the definitions herein, will control.

As used throughout this disclosure, the term "wellbore" refers to a bored well capable of receiving the acidic fracturing fluid. The wellbore can be placed horizontally, vertically, or positioned at any angle within the section of the geological formation that is targeted for stimulation and sequestration. The wellbore creates a path capable of permitting both fluids and apparatuses to traverse between the surface and the subsurface geological formation. In addition to defining the void of volume comprising the wellbore, the wellbore wall acts as the interface through which the acidic fracturing fluid other fluids can traverse between the wellbore and the geological formation. Furthermore, the design and setup of the wellbore can be dependent upon the specific properties of the system, including but not limited to, the characteristics of the geological formation, the depth of an injection/production zone in the geological formation, and the specific properties of the acidic fracturing fluid.

As used throughout this disclosure, the term "geological formation" refers to a body of rock that is sufficiently distinctive and continuous that it can be mapped, and can include a rock formation, a rock reservoir, a reactive rock reservoir, water containing formation, or deep aquifer, among others. As used herein, reactive rock can comprise mafic rocks, ultramafic rocks and entirely or in part of minerals and/or fragments thereof. The term mafic generally describes a silicate mineral or igneous rock that is rich in magnesium and iron. Mafic minerals can be dark in color, and examples of rock-forming mafic minerals include olivine, pyroxene, amphibole, and biotite. Examples of mafic rocks include basalt, diabase, and gabbro. Examples of ultramafic rocks include dunnite, peridotite, and pyroxenite. Chemically, mafic and ultramafic rocks can be enriched in iron, magnesium, and calcium. A geological formation comprising entirely or in part of mafic or ultramafic rock can allow components of an injected stream to react in-situ with the mafic rock components to precipitate and store components of the injected stream in the formation. In some embodiments, the mafic rock comprises basaltic rock. The geological formation may comprise in part or entirely of mineral and amorphous (e.g. volcanic glass) phases capable of chemically reacting with the injected stream to produce stable secondary compounds including but not limited to carbonates.

As used throughout this disclosure, the term "casing" refers to a portion of the wellbore wherein fluids cannot penetrate the wellbore walls to reach the formation. The casing may include a metallic or non-metallic pipe inside the wellbore. The casing may be centralized within the wellbore. The space between the casing and the wellbore walls may be filled with materials, such as but not limited to cement to ensure well stability and/or zonal insulation. The casing can be disposed within at least a portion of the wellbore.

As used throughout this disclosure, the term "formation conduit" refers to a channel that fluidly connects the wellbore with the surrounding geological formation. A formation conduit can be in fluid communication with the reactive rock and be configured to allow fluids, such as the acidic fracturing fluid, to be delivered to the reactive rock. The formation conduit can include an unlined portion of the wellbore wherein fluids can penetrate into the geological formation.

As used throughout this disclosure, the term "gaseous" refers to the state of matter with the properties and characteristics of a gas and does not refer to the supercritical state of matter.

As used throughout this disclosure, the term "microbubble" refers to a bubble ranging from about 1 micrometer to 10 micrometers in diameter. The small size of these microbubbles gives them unique physical and chemical properties, including but not limited to, increased surface area of up to 600 times of larger (macro) bubbles produced by conventional diffusers, decreased buoyancy, decreased velocity of motion, and increased resistance to bursting/collapse at higher pressures. Furthermore, the term "nanobubble" as used throughout this disclosure refers to bubbles with a diameter of less than 200 nanometers that exhibit properties including but not limited to, increased reactivity and stability due to their high specific surface area, high stagnation time, which may enhance the mass transfer efficiency and reactions at the gas-liquid interface, and decreased coalescence due to repulsive forces generated by electric charges at the gas-liquid interface.

As used throughout this disclosure, the term "hydraulic fracturing" or "hydraulically fracturing" refers to a stimulation treatment performed on geological formations where fracturing fluids are pumped into a geological formation at an elevated pressure such that fractures form within the geological formation.

As used throughout this disclosure, the term "acidizing" refers to the treatment of a subterranean formation with a stimulation fluid containing a reactive acid. The acidizing can improve the formation permeability to increase an injectivity of the geological formation.

As used throughout this disclosure, the term "carbonate" refers to rocks or fragments thereof that comprise 95% or more by weight carbonate minerals such as calcite ($CaCO_3$), aragonite (also $CaCO_3$), dolomite ($CaMg(CO_3)_2$), siderite ($FeCO_3$), ankerite (($Ca(Fe,Mg,Mn)(CO_3)_2$), etc. Carbonate, as referred throughout this disclosure could be the product of secondary processes such as alteration, weathering, or replacement of geological formations that comprise entirely or in part of reactive rocks, minerals or fragments thereof.

As used in the present disclosure, the term "substantially free" of a component means less than 1 wt. % of that component in a particular portion of a composition. For example, a dissolved $CO_2$ solution, which may be substantially free of free-phase CO, may comprise less than 1 wt. % of free-phase $CO_2$.

Referring now to FIG. 1, a method 100 of stimulating a geological formation and sequestering $CO_2$ in the geological formation is depicted. The method 100 may comprise positioning an acidic fracturing fluid comprising dissolved $CO_2$ and $CO_2$ microbubbles and/or $CO_2$ nanobubbles in the geological formation, at step 110, hydraulic fracturing the geological formation, at step 120, acidizing the geological formation with the acidic fracturing fluid, thereby increasing a permeability of the geological formation, at step 130, and sequestering $CO_2$ by reacting the $CO_2$ in the acidic fracturing fluid with reactive rock in the geological formation to form carbonates, at step 140.

As shown in the method 100 of FIG. 1, the method may comprise positioning the acidic fracturing fluid comprising dissolved $CO_2$ and $CO_2$ microbubbles and/or $CO_2$ nanobubbles in the geological formation, at step 110. In embodiments, the acidic fracturing fluid may be passed through an injection well casing within a wellbore to contact the reactive rock in the geological formation. The injection well casing may be disposed within the wellbore, extending downhole a depth within the wellbore, wherein a passage within the injection well casing may be in fluid communication with reactive rock of the geological formation.

In embodiments, the acidic fracturing fluid may be formed by combining a solution comprising dissolved $CO_2$ with microbubbles and/or nanobubbles of $CO_2$. In embodiments, the acidic fracturing fluid may be formed by dissolving gaseous $CO_2$ in an aqueous solution to form a dissolved $CO_2$ solution, and injecting $CO_2$ via microbubbles and/or nanobubbles into the dissolved $CO_2$ solution. In embodiments, the dissolved $CO_2$ solution may be a saturated $CO_2$ solution. In embodiments, the dissolved $CO_2$ solution may be an unsaturated $CO_2$ solution. In embodiments, the dissolved $CO_2$ solution may be substantially free of free-phase $CO_2$.

The aqueous solution may be one or more of deionized, tap, distilled, or fresh waters; natural, brackish, or saturated salt waters; marine waters, natural formation waters including but not limited to hydrocarbon formation produced waters, or synthetic brines; filtered or untreated seawaters; mineral waters; treated or untreated wastewater; or other potable or non-potable waters containing one or more dissolved salts, minerals, or organic materials. In embodiments, the aqueous solution may comprise at least 80 wt. %, at least 90 wt. %, at least 95 wt. %, at least 99 wt. %, at least 99.9 wt. % or even 100 wt. % of water. The aqueous solution may be sourced with certain specific properties including but not limited to temperature and salinity of the aqueous solution, which may impact the solubility of $CO_2$ and/or the design, material and operation of the microbubble/nanobubble generator.

In embodiments, the $CO_2$ microbubbles and/or $CO_2$ nanobubbles may be gaseous $CO_2$ microbubbles and/or gaseous $CO_2$ nanobubbles. In embodiments, the $CO_2$ microbubbles and/or $CO_2$ nanobubbles may be supercritical $CO_2$ microbubbles and/or supercritical $CO_2$ nanobubbles.

Without intending to be bound by any particular theory, it is believed that the injection of microbubbles and/or nanobubbles of $CO_2$ into the dissolved $CO_2$ solution may produce a supersaturated $CO_2$ solution, which may have a concentration of $CO_2$ greater than a saturated dissolved $CO_2$ solution, thereby increasing an amount of $CO_2$ that may be sequestered within the geological formation. Further, it is believed that the addition of supercritical $CO_2$ microbubbles and/or supercritical $CO_2$ nanobubbles in the acidic fracturing fluid compared to gaseous $CO_2$ microbubbles and/or gaseous $CO_2$ nanobubbles alone, may result in a greater amount of $CO_2$ in the acidic fracturing fluid, thereby increasing the acid-generating capacity of the fracturing fluid, which may increase a penetration depth of the acidic fracturing fluid into the geological formation. This increased penetration depth of the acidic fracturing fluid may enhance the efficacy of the acidification, which may increase the amount of $CO_2$ that can be delivered and sequestered in the geological formation.

The methods described herein may produce an acidic fracturing fluid comprising greater than or equal to 5 weight percent (wt. %) and less than or equal to 35 wt. % $CO_2$, based on the total weight of the acidic fracturing fluid. For instance the acidic fracturing fluid may comprise from 5 wt. % to 35 wt. %, from 6 wt. % to 30 wt. %, from 7 wt. % to 25 wt. %, from 8 wt. % to 20 wt. %, from 9 wt. % to 15 wt. % $CO_2$, or any and all ranges and sub-ranges between the foregoing values, based on the total weight of the acidic fracturing fluid. Without intending to be bound by any particular theory, it is beloved that if an amount of $CO_2$ is added to the acidic fracturing fluid beyond the saturation limit of the acidic fracturing fluid, the $CO_2$ may form a free phase gas and/or exsolve when a pressure in the geological formation dissipates, which may decrease the permeability of the geological formation.

In embodiments, the acidic fracturing fluid may comprise, consist essentially of, or consist of water, carbonic acid, and $CO_2$. In embodiments, at least 80 wt. %, at least 85 wt. %, at least 90 wt. %, at least 95 wt. %, at least 99 wt. %, at least 99.9 wt. %, or even 100 wt. % of the acidic fracturing fluid may include water, carbonic acid, and $CO_2$.

As shown in the method 100 of FIG. 1, the method may comprise hydraulic fracturing the geological formation, at step 120. In embodiments, the hydraulic fracturing may comprise injecting the acidic fracturing fluid in the geological formation at a pressure above the geological formation fracturing pressure. A wellbore of the geological formation may be considered as the primary path in which the acidic fracturing fluid flows into the geological formation. The acidic fracturing fluid may be introduced into the wellbore at high pressures and flow rates. The pressure and flow rate will vary depending on the type and properties of the geological formation. Regardless, the acidic fracturing fluid may be introduced into the wellbore at a pressure and flow rate such that the pressure created inside the target geological formation is greater than the fracturing pressure of geological so as to propagate fractures, generate fractures, or both. As used in the present disclosure, the term "fracturing pressure" refers to a pressure greater than which the injection of fluids will cause the geological formation to fracture hydraulically.

In embodiments, the acidic fracturing fluid may be injected at a pressure above the geological formation fracturing pressure, thereby hydraulically fracturing the geological formation. The hydraulic fracturing may increase a permeability of the geological formation, thereby increasing a volume of the acidic fracture fluid that may be injected into the wellbore, increasing a volume of the acidic fracture fluid that may reach the reactive rock in the geological formation, or both. The increased volume of the acidic fracturing fluid that may be injected into the wellbore and/or reach the reactive rock in the formation may increase an amount of $CO_2$ that may be sequestered within the geological formation.

In embodiments, the hydraulic fracturing may include first injecting the acidic fracturing fluid at a pressure below the geological formation fracturing pressure, and then injecting the acidic fracturing fluid at a pressure above the geological formation fracturing pressure. In embodiments, a first portion of the acidic fracturing fluid may be injected into the geological formation at a pressure below the geological formation fracturing pressure, and a second portion of the acidic fracturing fluid may be injected into the geological formation at a pressure above the geological formation fracturing pressure.

As shown in the method 100 of FIG. 1, the method may comprise acidizing the geological formation with the acidic fracturing fluid, thereby increasing a permeability of the geological formation, at step 130. In embodiments, the acidizing may comprise treating the geological formation with the dissolved $CO_2$ in the acidic fracturing fluid. The dissolved $CO_2$ (carbonic acid) may be operable to dissolve at least a portion of geological formation, thereby increasing a permeability of the geological formation, and/or increasing an injectivity of the geological formation. In embodiments, the acidizing may produce wormholes, conductive fractures, or combinations thereof in the geological formation.

In embodiments, the acidizing may be carried out during the hydraulic fracturing or following the hydraulic fracturing.

In embodiments, the acidic fracturing fluid may not comprise a strong acid. In embodiments, the acidic fracturing fluid may not comprise an organic acid. In embodiments, the acidic fracturing fluid may not comprise a strong acid or an organic acid.

In embodiments, the acidizing may not comprise treating the geological formation with a strong acid. In embodiments, the acidizing may not comprise treating the geological formation with an organic acid. In embodiments, the acidizing may not comprise treating the geological formation with a strong acid, an organic acid, or combinations thereof.

In embodiments, the acidizing may comprise treating the geological formation with an acid, wherein the acid consists of mineral acids. In embodiments, the acidizing may comprise treating the geological formation with an acid, wherein the acid consists of carbonic acid.

In embodiments, the acidizing may comprise treating the geological formation with an acid, wherein at least 80 wt. %, at least 85 wt. %, at least 90 wt. %, at least 95 wt. %, at least 99 wt. %, or 100 wt. % of the acid is carbonic acid present in the acidic fracturing fluid prior to positioning the acidic fracturing fluid in the geological formation, based on the total weight of the acid. In some embodiments, the entirety of the acid in the acidic fracturing fluid may be provided through the dissolution of $CO_2$ in the acidic fracturing fluid.

Without intending to be bound by any particular theory, it is believed that conventional acidizing methods that use strong acids may produce water insoluble minerals, which may damage the geological formation, reduce the injectivity of the geological formation, or both. Dissolution of basalt and/or other mafic igneous rocks with strong acids, which have fast reaction kinetics, may result in the formation of insoluble secondary phases such as amorphous silica, kaolinite, and/or Al—Fe oxyhydroxides. Furthermore, it is believed that the strong proton consuming (base) response of the basalts and other reactive rocks upon dissolution may rapidly raise the pH of the ambient solution away from the wellbore, which may lead to supersaturation and the eventual precipitation of other water insoluble mineral phases, such as clays and zeolites. Further, many of these secondary minerals are nonreactive with carbonic acid. Therefore, by replacing the original reactive rock minerals with nonreactive minerals and by filling the reactive matrix porosity and/or larger open spaces such as vesicles and fractures, the dissolution of basalt and other reactive rocks with strong acids may have a significant negative impact not only on the reactivity but also on the permeability of the geological formation.

In embodiments, the use of dissolved $CO_2$ (carbonic acid) instead of conventional strong acids, may produce acid-soluble carbonates, which may continue to be dissolved and redeposited further in the geological formation during subsequent injections of the acidic fracturing fluid, and/or the continuous injection of $CO_2$-loaded aqueous fluids, thereby increasing an amount of $CO_2$ that may be sequestered within the geological formation.

Without intending to be bound by any particular theory, it is believed that the use of conventional strong acids for acidizing a geological formation, wherein the geological formation may already include calcite and/or other carbonate minerals, may produce free phase gaseous $CO_2$. The production of free phase gaseous $CO_2$ may result in the formation of $CO_2$ gas filled domains at irreducible water saturation, which could temporarily or permanently reduce permeability by preventing aqueous fluid flow (injectivity) by capillary forces. The formation of free gas phase domains may also slow down reactive rock dissolution since it may only proceed in an aqueous milieu.

In embodiments, the use of dissolved $CO_2$ (carbonic acid) instead of conventional strong acids, may reduce an amount of free phase gaseous $CO_2$ produced during the acidizing, thereby maintaining or increasing the permeability of the geological formation. Further, the exclusion of strong acids in the acidizing fluid may reduce a rate of corrosion of the wellbore or operational equipment compared to conventional acidizing that includes strong acids, thereby reducing the operational cost of methods and systems described herein.

In embodiments, the inclusion of $CO_2$ microbubbles and/or $CO_2$ nanobubbles in the acidic fracturing fluid during the acidizing may increase the permeability and/or injectivity of the geological formation compared to methods that do not include $CO_2$ microbubbles and/or $CO_2$ nanobubbles in the acidic fracturing fluid during the acidizing. Without intending to be bound by any particular theory, it is believed that the small physical size of the $CO_2$ microbubbles and/or $CO_2$ nanobubbles would allow the $CO_2$ to be carried further and deeper into fine micron-sized fractures and or into porous matrix spaces, where upon their eventual collapse the microbubbles and/or nanobubbles will provide $CO_2$ needed to acidify the ambient fluid and enhance the dissolution of the reactive minerals and rocks. Further, it is believed that the relative stability and neutral to negative buoyancy of the $CO_2$ microbubbles and/or $CO_2$ nanobubbles may reduce or preclude potential buoyancy-driven flow issues as well as the coalescence and formation of $CO_2$ single phase accumulations in the geological formation.

As shown in the method 100 of FIG. 1, the method may comprise sequestering $CO_2$ by reacting the $CO_2$ in the acidic fracturing fluid with reactive rock in the geological formation to form carbonates, at step 140.

In embodiments, the $CO_2$ in the acidic fracturing fluid may react with reactive rock in the geological formation, thereby forming stable carbonates within the geological formation. The mineralization of $CO_2$ with the geological formation may sequester the $CO_2$ within the geological formation. In embodiments, the acidic fracturing fluid may enter the wellbore of the geological formation and reach reactive rock in the geological formation via a formation conduit. In embodiments, the hydraulic fracturing and the acidizing steps of the methods disclosed herein may increase a concentration of $CO_2$ that may be sequestered within the geological formation.

In embodiments, the geological formation may comprise a reactive rock that comprises entirely or in part of a reactive mineral and/or amorphous phases. In embodiments, the reactive rock of the geological formation may comprise reactive mineral and/or amorphous phases comprising mafic rocks (e.g. basalts). In embodiments, the reactive rock of the geological formation may comprise reactive minerals comprising ultramafic rocks. In embodiments, the reactive rock of the geological formation may comprise entirely or in part of reactive minerals and/or amorphous phases comprising mafic rock, ultramafic rock, or combinations thereof.

In embodiments, the formed carbonates may be soluble in carbonic acid, therefore multiple injections of the acidic fracturing fluid comprising the dissolved $CO_2$ and $CO_2$ microbubbles, and/or $CO_2$ nanobubbles in the geological formation may continue to dissolve and redeposit these carbonates further into the geological formation, thereby increasing near-wellbore permeability and injectivity and hence the amount of $CO_2$ that may be sequestered within the geological formation.

In embodiments, the method may include treating an injection site of the geological formation comprising a water injection well. The treatment of the water injection well may increase a rate at which $CO_2$-rich water may be injected into the water injection well.

In embodiments, the method may include treating a production site of the geological formation that includes a water production well. The treatment of the water production well may increase a rate of water production from the water production well. In such embodiments, the water produced from the water production well may be used for $CO_2$ dissolution to form a dissolved gas solution, and the dissolved gas solution may be subsequently injected into the water injection well.

Figure 2:
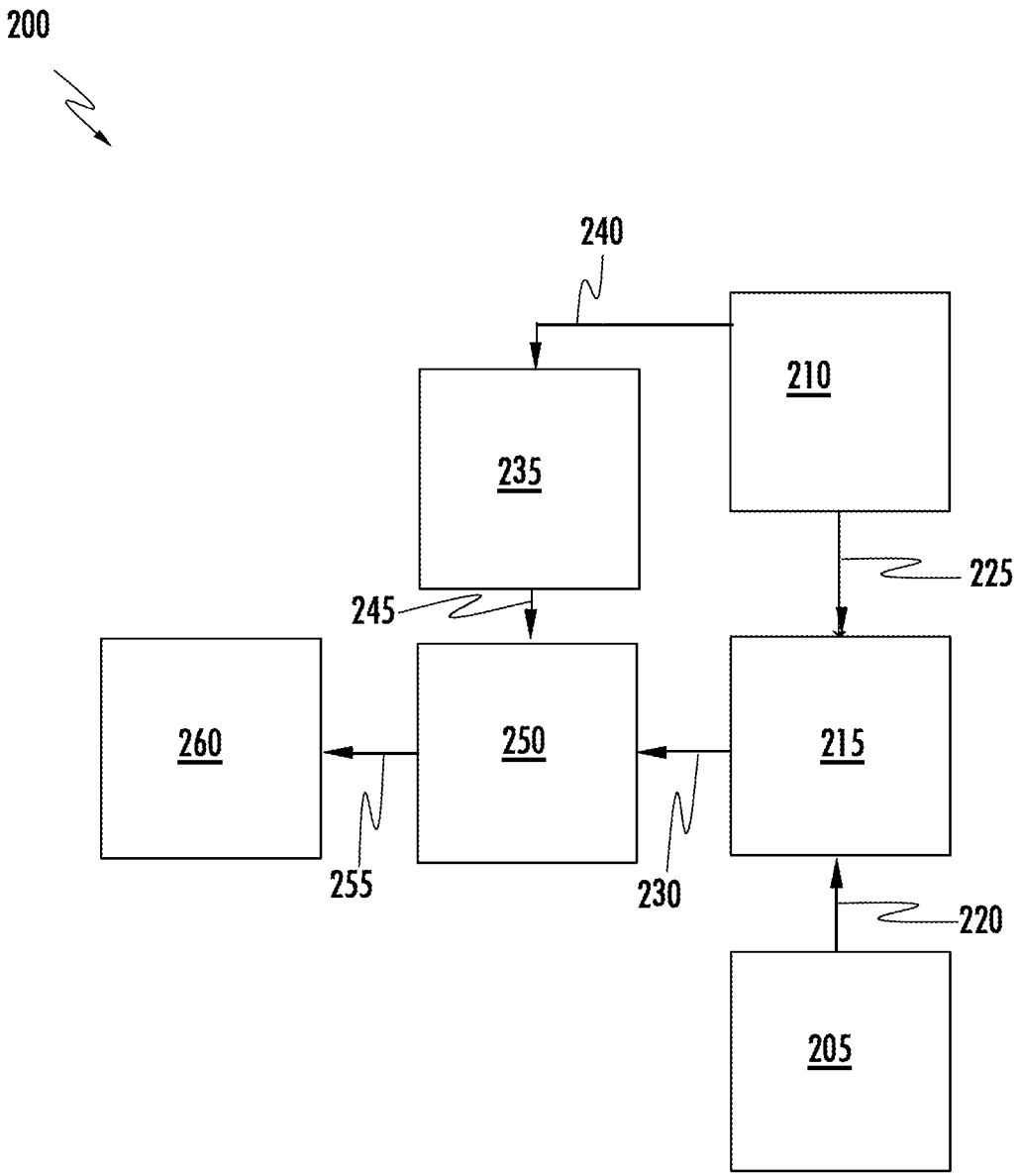
FIG. 2 schematically depicts a system for stimulating a geological formation and sequestering $CO_2$ in the geological formation, according to one or more embodiments of the present disclosure.

Now referring to FIG. 2, an example system 200 that may be suitable for use with the methods and/or apparatuses described herein is schematically depicted. The system 200 may include an aqueous solution source 205, a gaseous $CO_2$ source 210, and a vessel 215 operable to receive an aqueous solution 220 from the aqueous solution source 205 and gaseous $CO_2$ 225 from the gaseous $CO_2$ source 210. The vessel 215 may be configured to dissolve the gaseous $CO_2$ 225 in the aqueous solution 220, thereby forming a dissolved $CO_2$ solution 230. The system 200 may also include a microbubble/nanobubble generator 235 configured to receive gaseous $CO_2$ 240 from the gaseous $CO_2$ source 210, or from a separate $CO_2$ source (not shown), such as a supercritical $CO_2$ source. The microbubble/nanobubble generator 235 may produce $CO_2$ microbubbles and/or $CO_2$ nanobubbles 245. The system 200 may also include a fracturing fluid tank 250 operable to receive the dissolved $CO_2$ solution 230 and the $CO_2$ microbubbles and/or $CO_2$ nanobubbles 245, thereby forming an acidic fracturing fluid 255. The acidic fracturing fluid 255 may be injected into a wellbore 260 within a geological formation. In embodiments, the fracturing fluid tank 250 may be pressurized at a desired pressure based upon use, such as at a pressure above the fracturing pressure of the geological formation for hydraulically fracturing the geological formation. In embodiments, the system 200 may include one or more pressurized tanks operable to receive the acidic fracturing fluid 255 from the fracturing fluid tank 250 (not shown), where a pressure of each of the pressurized tanks is independently maintained, such as a first pressurized tank at relatively high pressure for hydraulically fracturing the geological formation and a second pressurized tank at a reduced pressure relative to the first fracturing fluid tank for acidizing the geological formation.

The methods described herein may limit the formation of secondary water insoluble crystalline and/or amorphous phases that can damage the reservoir injectivity and reactivity by promoting the formation of acid soluble carbonate minerals such as calcite, which may re-dissolve and re-precipitate further into the geological formation, thus facilitating the sequestration of $CO_2$ in the geological formation. The specific combination of hydraulic fracturing and acidizing using the acidic fracturing fluid, as described herein may provide increased permeability (injectivity and productivity) of the geological formation, thereby increasing the rate of injection of $CO_2$-loaded fluid in the geological formation may increase the efficiency at which the $CO_2$ is sequestered within the geological formation. Further, the unique properties of the $CO_2$ microbubbles and/or $CO_2$ nanobubbles in the acidic fracturing fluid may increase the total mass of $CO_2$ into the acid fracturing fluid, thereby producing a stable supersaturated $H_2O$—$CO_2$ solution. Further, the small size, low buoyancy and relative stability of the $CO_2$ microbubbles and/or the $CO_2$ nanobubbles may allow the $CO_2$ microbubbles and/or $CO_2$ nanobubbles to penetrate further into microfractures within the geological formation, thereby extending the impact zone of the acid fracturing stimulation further into the geological formation.

A first aspect of the present disclosure is directed to a method of stimulating a geological formation, the method comprising positioning an acidic fracturing fluid comprising dissolved $CO_2$ and $CO_2$ microbubbles and/or $CO_2$ nanobubbles in the geological formation; hydraulic fracturing the geological formation; acidizing the geological formation with the acidic fracturing fluid, thereby increasing a permeability of the geological formation; and sequestering $CO_2$ by reacting the $CO_2$ in the acidic fracturing fluid with reactive rock in the geological formation to form carbonates.

A second aspect of the present disclosure may include the first aspect, wherein the positioning comprises passing the acidic fracturing fluid through an injection well casing to contact the reactive rock in the geological formation.

A third aspect of the present disclosure may include the first or second aspect, wherein the acidic fracturing fluid is formed by: dissolving gaseous $CO_2$ in an aqueous solution to form a dissolved $CO_2$ solution; and injecting $CO_2$ via microbubbles and/or nanobubbles into the dissolved $CO_2$ solution, thereby forming the acidic fracturing fluid.

A fourth aspect of the present disclosure may include the third aspect, wherein the dissolved $CO_2$ solution is substantially free of free-phase $CO_2$.

A fifth aspect of the present disclosure may include any one of the first through third aspects, wherein the acidic fracturing fluid comprises greater than or equal to 5 weight percent $CO_2$, based on the total weight of the acidic fracturing fluid.

A sixth aspect of the present disclosure may include any one of the first through fifth aspects, wherein the $CO_2$ in acidic fracturing fluid comprises less than or equal to 35 weight percent supercritical $CO_2$, based on the total weight of $CO_2$ in the acidic fracturing fluid.

A seventh aspect of the present disclosure may include any one of the first through sixth aspects, wherein the acidic fracturing fluid does not comprise supercritical $CO_2$.

An eighth aspect of the present disclosure may include any one of the first through seventh aspects, wherein the acidic fracturing fluid consists essentially of water, carbonic acid, and $CO_2$.

A ninth aspect of the present disclosure may include any one of the first through eighth aspects, wherein the hydraulic fracturing comprises injecting the acidic fracturing fluid in the geological formation at a pressure above the geological formation fracturing pressure.

A tenth aspect of the present disclosure may include any one of the first through ninth aspects, wherein a first portion of the acidic fracturing fluid is injected into the geological formation at a pressure below the geological formation fracturing pressure, and a second portion of the acidic fracturing fluid is injected into the geological formation at a pressure above the geological formation fracturing pressure.

An eleventh aspect of the present disclosure may include any one of the first through tenth aspects, wherein the acidizing comprises treating the geological formation with the dissolved $CO_2$ in the acidic fracturing fluid.

A twelfth aspect of the present disclosure may include any one of the first through eleventh aspects, wherein the acidizing does not comprise treating the geological formation with a strong acid.

A thirteenth aspect of the present disclosure may include any one of the first through twelfth aspects, wherein the acidizing does not comprise treating the geological formation with an organic acid.

A fourteenth aspect of the present disclosure may include any one of the first through thirteenth aspects, wherein the acidic fracturing fluid does not comprise a strong acid.

A fifteenth aspect of the present disclosure may include any one of the first through fourteenth aspects, wherein the acidic fracturing fluid does not comprise an organic acid.

A sixteenth aspect of the present disclosure may include any one of the first through fifteenth aspects, wherein the geological formation comprises a water injection well, and the method comprises increasing a rate of injection of $CO_2$-rich water into the water injection well.

A seventeenth aspect of the present disclosure may include any one of the first through sixteenth aspects, wherein the geological formation comprises a water production well, and the method comprises increasing a rate of water production from the water production well.

An eighteenth aspect of the present disclosure may include any one of the first through seventeenth aspects, wherein the geological formation comprises a water injection well and a water production well, and the method further comprises: producing water from the water production well; dissolving $CO_2$ in the water produced from the water production well to form a $CO_2$-rich solution; and injecting the $CO_2$-rich solution into the water injection well, thereby further sequestering the $CO_2$ in the geological formation.

A nineteenth aspect of the present disclosure may include any one of the first through eighteenth aspects, wherein the reactive rock comprises mafic rock, ultramafic rock, or combinations thereof.

It will be apparent to persons of ordinary skill in the art that various modifications and variations can be made without departing from the scope disclosed herein. Since modifications, combinations, sub-combinations, and variations of the disclosed embodiments, which incorporate the spirit and substance disclosed herein, may occur to persons of ordinary skill in the art, the scope disclosed herein should be construed to include everything within the scope of the appended claims and their equivalents.

For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" or "consists essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

It should be understood that any two quantitative values assigned to a property may constitute a range of that property, and all combinations of ranges formed from all stated quantitative values of a given property are contemplated in this disclosure. The subject matter disclosed herein has been described in detail and by reference to specific embodiments. It should be understood that any detailed description of a component or feature of an embodiment does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

What is claimed is:

1. A method of stimulating a geological formation, the method comprising:

positioning an acidic fracturing fluid comprising dissolved $CO_2$ and at least one of $CO_2$ microbubbles or $CO_2$ nanobubbles in the geological formation, wherein the acidic fracturing fluid is injected in the geological formation at a pressure above a fracturing pressure of the geological formation thereby hydraulically fracturing the geological formation;

acidizing the geological formation with the acidic fracturing fluid, thereby increasing a permeability of the geological formation; and sequestering $CO_2$ by reacting the $CO_2$ in the acidic fracturing fluid with reactive rock in the geological formation to form carbonates.

2. The method of claim 1, wherein the positioning comprises passing the acidic fracturing fluid through an injection well casing to contact the reactive rock in the geological formation.

3. The method of claim 1, wherein the acidic fracturing fluid is formed by:

dissolving gaseous $CO_2$ in an aqueous solution to form a dissolved $CO_2$ solution; and injecting $CO_2$ via at least one of microbubbles or nanobubbles into the dissolved $CO_2$ solution, thereby forming the acidic fracturing fluid.

4. The method of claim 3, wherein the dissolved $CO_2$ solution is substantially free of free-phase $CO_2$.

5. The method of claim 1, wherein the acidic fracturing fluid comprises greater than or equal to 5 weight percent and less than or equal to 35 weight percent $CO_2$, based on the total weight of the acidic fracturing fluid.

6. The method of claim 1, wherein the $CO_2$ in acidic fracturing fluid comprises less than or equal to 35 weight percent supercritical $CO_2$, based on the total weight of $CO_2$ in the acidic fracturing fluid.

7. The method of claim 1, wherein the acidic fracturing fluid does not comprise supercritical $CO_2$.

8. The method of claim 1, wherein the acidic fracturing fluid consists essentially of water, carbonic acid, and $CO_2$.

9. The method of claim 1, wherein the hydraulic fracturing comprises injecting the acidic fracturing fluid in the geological formation at a pressure above the geological formation fracturing pressure.

10. The method of claim 1, wherein a first portion of the acidic fracturing fluid is injected into the geological formation at a pressure below the geological formation fracturing pressure, and a second portion of the acidic fracturing fluid is injected into the geological formation at a pressure above the geological formation fracturing pressure.

11. The method of claim 1, wherein the acidizing comprises treating the geological formation with the dissolved $CO_2$ in the acidic fracturing fluid.

12. The method of claim 1, wherein the acidizing does not comprise treating the geological formation with a strong acid.

13. The method of claim 1, wherein the acidizing does not comprise treating the geological formation with an organic acid.

14. The method of claim 1, wherein the acidic fracturing fluid does not comprise a strong acid.

15. The method of claim 1, wherein the acidic fracturing fluid does not comprise an organic acid.

16. The method of claim 1, wherein the geological formation comprises a water injection well, and the method comprises injecting the acidic fracturing fluid into the water injection well.

17. The method of claim 1, wherein the geological formation comprises a water production well, and the method comprises producing water from the water production well, wherein the acidic fracturing fluid comprises the water from the water production well.

18. The method of claim 1, wherein the geological formation comprises a water injection well and a water production well, and the method further comprises:

producing water from the water production well;

dissolving $CO_2$ in the water produced from the water production well to form the acidic fracturing fluid; and injecting the acidic fracturing fluid into the water injection well, thereby further sequestering the $CO_2$ in the geological formation.

19. The method of claim 1, wherein the reactive rock comprises mafic rock, ultramafic rock, or combinations thereof.

* * * * *